US010617924B2

(12) United States Patent
Matsushima et al.

(10) Patent No.: US 10,617,924 B2
(45) Date of Patent: Apr. 14, 2020

(54) ARTIFICIAL SHUTTLECOCK FEATHER AND SHUTTLECOCK

(71) Applicants: YONEX KABUSHIKI KAISHA, Tokyo (JP); TOHOKU UNIVERSITY, Miyagi (JP)

(72) Inventors: Yusuke Matsushima, Tokyo (JP); Takumi Sakaguchi, Tokyo (JP); Yasufumi Konishi, Miyagi (JP)

(73) Assignees: YONEX KABUSHIKI KAISHA, Tokyo (JP); TOHOKU UNIVERSITY, Miyagi (JP)

( * ) Notice: Subject to any disclaimer, the term of this patent is extended or adjusted under 35 U.S.C. 154(b) by 0 days.

(21) Appl. No.: 16/300,221

(22) PCT Filed: Apr. 28, 2017

(86) PCT No.: PCT/JP2017/016888

§ 371 (c)(1),
(2) Date: Nov. 9, 2018

(87) PCT Pub. No.: WO2017/195647

PCT Pub. Date: Nov. 16, 2017

(65) Prior Publication Data

US 2019/0151735 A1 May 23, 2019

(30) Foreign Application Priority Data

May 9, 2016 (JP) ..... 2016-093666

(51) Int. Cl.
*A63B 67/19* (2016.01)
*A63B 67/187* (2016.01)
*A63B 102/04* (2015.01)

(52) U.S. Cl.
CPC ..... *A63B 67/19* (2016.01); *A63B 67/187* (2016.01); *A63B 2102/04* (2015.10)

(58) Field of Classification Search
CPC ..... A63B 67/18; A63B 67/187; A63B 67/19; A63B 67/197
(Continued)

(56) References Cited

U.S. PATENT DOCUMENTS 1,620,922 A * 3/1927 Saunders ..... A63B 67/187 473/579
2,153,251 A * 4/1939 Hudson ..... A63B 67/18 473/580
(Continued)

FOREIGN PATENT DOCUMENTS

EP 3 228 3689 A1 10/2017
JP S49-048424 A 5/1974
(Continued)

OTHER PUBLICATIONS

EP 17796008.5 Search Report, dated Nov. 19, 2019.

*Primary Examiner* — Alexander R Niconovich
(74) *Attorney, Agent, or Firm* — Brinks Gilson & Lione

(57) ABSTRACT

An artificial shuttlecock feather for implanting in a circular ring shape into a shuttlecock base, including: a vane section and a rachis section having one end in an axial direction of the rachis section fixed to the base and supporting the vane section provided to another end side of the rachis section, a hole being formed in the vane section so as to penetrate the vane section, and a porosity of a first region of the vane section being lower than a porosity of a second region of the vane section, the first region spanning from an edge on the one end side in the axial direction to a predetermined position further toward the one end side than a center of vane section in the axial direction, the second region spanning from the predetermined position to an edge on the other end side in the axial direction.

8 Claims, 11 Drawing Sheets

(58) Field of Classification Search
USPC ..... 473/579
See application file for complete search history.

(56) References Cited

U.S. PATENT DOCUMENTS

| | | | | | |
|---|---|---|---|---|---|
| 2,163,236 | A * | 6/1939 | Collier | A63B 67/18 | 473/579 |
| 2,556,029 | A * | 6/1951 | Cohan | A63B 67/187 | 473/580 |
| 2,632,647 | A * | 3/1953 | Carlton | A63B 67/187 | 473/579 |
| D170,503 | S * | 9/1953 | Lawner et al. | A63B 67/18 | D21/711 |
| 2,734,746 | A * | 2/1956 | Sametz et al. | A63B 67/187 | 473/579 |
| 2,761,685 | A * | 9/1956 | Lashley | A63B 67/193 | 473/579 |
| 2,830,817 | A | 4/1958 | Schoberl | | |
| 3,313,543 | A * | 4/1967 | Carlton | A63B 67/187 | 473/579 |
| 3,831,943 | A * | 8/1974 | Popplewell | A63B 67/187 | 473/579 |
| 3,891,215 | A * | 6/1975 | Maconachie | A63B 67/187 | 473/579 |
| 3,904,205 | A * | 9/1975 | Robinson | A63B 67/187 | 473/579 |
| 4,305,589 | A * | 12/1981 | Popplewell | A63B 67/193 | 473/579 |
| 4,509,761 | A * | 4/1985 | Liu | A63B 67/193 | 473/579 |
| 5,421,587 | A * | 6/1995 | Mao-Huang | A63B 67/187 | 473/579 |
| 5,853,340 | A * | 12/1998 | Willis | A63B 67/193 | 473/579 |
| 6,227,991 | B1 * | 5/2001 | Carlton | A63B 67/187 | 473/579 |
| 6,709,353 | B1 * | 3/2004 | Peterson | A63B 67/18 | 473/579 |
| 6,890,274 | B2 * | 5/2005 | Carlton | A63B 67/18 | 473/579 |
| 7,258,635 | B2 * | 8/2007 | Brandes | A63B 67/193 | 473/579 |
| 8,105,185 | B2 * | 1/2012 | Tanaka | A63B 67/193 | 473/579 |
| 8,585,518 | B2 * | 11/2013 | Dai | A63B 67/19 | 473/580 |
| 8,686,082 | B2 * | 4/2014 | Li | C08L 51/06 | 524/445 |
| 9,061,193 | B2 * | 6/2015 | Dai | A63B 67/18 | |
| 9,132,328 | B1 * | 9/2015 | Daole | A63B 67/18 | |
| 9,440,130 | B2 * | 9/2016 | Dai | A63B 67/18 | |
| 9,937,399 | B1 * | 4/2018 | Peterson | A63B 67/187 | |
| 10,065,096 | B2 * | 9/2018 | Chen | A63B 67/187 | |
| 10,240,284 | B2 * | 3/2019 | Anand | F42B 6/06 | |
| 2013/0210564 | A1 * | 8/2013 | Yoneyama | A63B 67/18 | 473/580 |
| 2017/0291085 | A1 * | 10/2017 | Chen | A63B 67/18 | |

FOREIGN PATENT DOCUMENTS

| | | | |
|---|---|---|---|
| JP | 2010-042240 | A | 2/2010 |
| JP | 2012-011175 | A | 1/2012 |
| JP | 2012-024157 | A | 2/2012 |

* cited by examiner

ARTIFICIAL SHUTTLECOCK FEATHER AND SHUTTLECOCK

RELATED APPLICATION

This application is the U.S. National Phase under 35 U.S.C. § 371 of International Application No. PCT/JP2017/016888, filed Apr. 28, 2017, which in turn claims the benefit of Japanese Application No. 2016-093666, filed May 9, 2016, the contents of which are incorporated herein by reference in their entirety.

TECHNICAL FIELD

The present invention relates to an artificial shuttlecock feather and a shuttlecock.

BACKGROUND ART

Badminton shuttlecocks include those that employ feathers (natural feathers) of waterfowl for their feathers (natural feather shuttlecocks), and those that employ artificial feathers synthetically manufactured from a nylon resin or the like therefor (artificial feather shuttlecocks).

As is widely known, natural feather shuttlecocks have a structure using 16 or so natural feathers from a goose, duck, or the like, with a base end of the rachis of each feather implanted into a hemispherical mounting block (base) configured from leather-covered cork or the like. The feathers employed in natural feather shuttlecocks have a low relative density and are extremely light in weight. The rachises of such feathers also have high rigidity. Natural feather shuttlecocks therefore have a distinctive flight performance and a satisfying sensation is obtained when they are hit.

Although artificial feather shuttlecocks provided with feathers made from resin integrally molded into a ring shape are well known, the feathers are not able to move individually independently of each other in such artificial feather shuttlecocks in the same manner as in natural feather shuttlecocks. This makes it difficult to obtain flight performance similar to that of natural feather shuttlecocks.

There are accordingly proposals for artificial feathers modelled on feathers, as described in Patent Literature 1 below. Namely, there is a proposal for an artificial feather shuttlecock with artificial feathers including a vane section and a rachis section to support the vane section.

CITATION LIST

Patent Literature

Patent Literature 1: JP 2012-24157 A

SUMMARY OF INVENTION

Technical Problem

In artificial feather shuttlecocks employing artificial feathers modelled on feathers, if an attempt is made to match the weight of the artificial feathers to that of natural feathers then there is insufficient rigidity and durability deteriorates. Moreover, if an attempt is made to match rigidity, then the weight increases and flight performance deteriorates. Even if a balance is found between weight and rigidity, flight performance is inferior due to the rigidity being lower and the weight being heavier than that of natural feathers.

In consideration of the above issues, an object of the invention is to improve flight performance.

Solution to Problem

A main aspect for achieving the object is an artificial shuttlecock feather that is to be implanted in a circular ring shape into a base of a shuttlecock, the artificial shuttlecock feather including:

a vane section; and a rachis section having one end in an axial direction of the rachis section fixed to the base and supporting the vane section provided to another end side of the rachis section, a plurality of holes being formed in the vane section so as to penetrate the vane section, and a porosity of a first region of the vane section being lower than a porosity of a second region of the vane section, the first region spanning from an edge on the one end side in the axial direction to a predetermined position further toward the one end side than a center of the vane section in the axial direction, the second region spanning from the predetermined position to an edge on the other end side in the axial direction.

Other features of this invention will become clear from descriptions of this specification and drawings.

Advantageous Effects of Invention

The artificial shuttlecock feather of the invention is capable of improving flight performance.

DESCRIPTION OF EMBODIMENTS

Overview

At least the below matters will become clear from descriptions of this specification and drawings.

An artificial shuttlecock feather that is to be implanted in a circular ring shape into a base of a shuttlecock will become clear, the artificial shuttlecock feather including: a vane section; and a rachis section having one end in an axial direction of the rachis section fixed to the base and supporting the vane section provided to another end side of the rachis section, a hole being formed in the vane section so as to penetrate the vane section, and a porosity of a first region of the vane section being lower than a porosity of a second region of the vane section, the first region spanning from an edge on the one end side in the axial direction to a predetermined position further toward the one end side than a center of the vane section in the axial direction, the second region spanning from the predetermined position to an edge on the other end side in the axial direction.

Such an artificial shuttlecock feather is capable of raising an aerodynamic characteristic (pitching moment), and is capable of achieving improved flight performance.

According to the artificial shuttlecock feather, wherein preferably the porosity of the first region is 0%.

Such an artificial shuttlecock feather is capable of further improving flight performance.

According to the artificial shuttlecock feather, wherein preferably the predetermined position is a position of greatest pressure difference between one surface of the vane section and another surface of the vane section during flight of the shuttlecock.

Such an artificial shuttlecock feather is capable of suppressing a reduction in lift.

According to the artificial shuttlecock feather, wherein preferably a plurality of the holes are formed, and a length from the edge on the one end side of the vane section to the predetermined position is greater than a separation between adjacent holes out of the holes.

According to the artificial shuttlecock feather, wherein preferably the hole is an elongated hole.

Such an artificial shuttlecock feather enables an airflow to pass efficiently through from a surface on one side thereof to a surface on the other side thereof, enabling separation of airflow to be suppressed as well as enabling lift to be increased.

According to the artificial shuttlecock feather, wherein preferably the porosity of the vane section taken as a whole is from 5% up to, but not including, 30%.

Such an artificial shuttlecock feather is capable of obtaining flight performance close to that of a natural feather shuttlecock, and is also capable of securing durability.

A shuttlecock employing the above artificial shuttlecock feather is also made clear.

Embodiments

<Basic Structure of Artificial Feather Shuttlecock>

Figure 1:
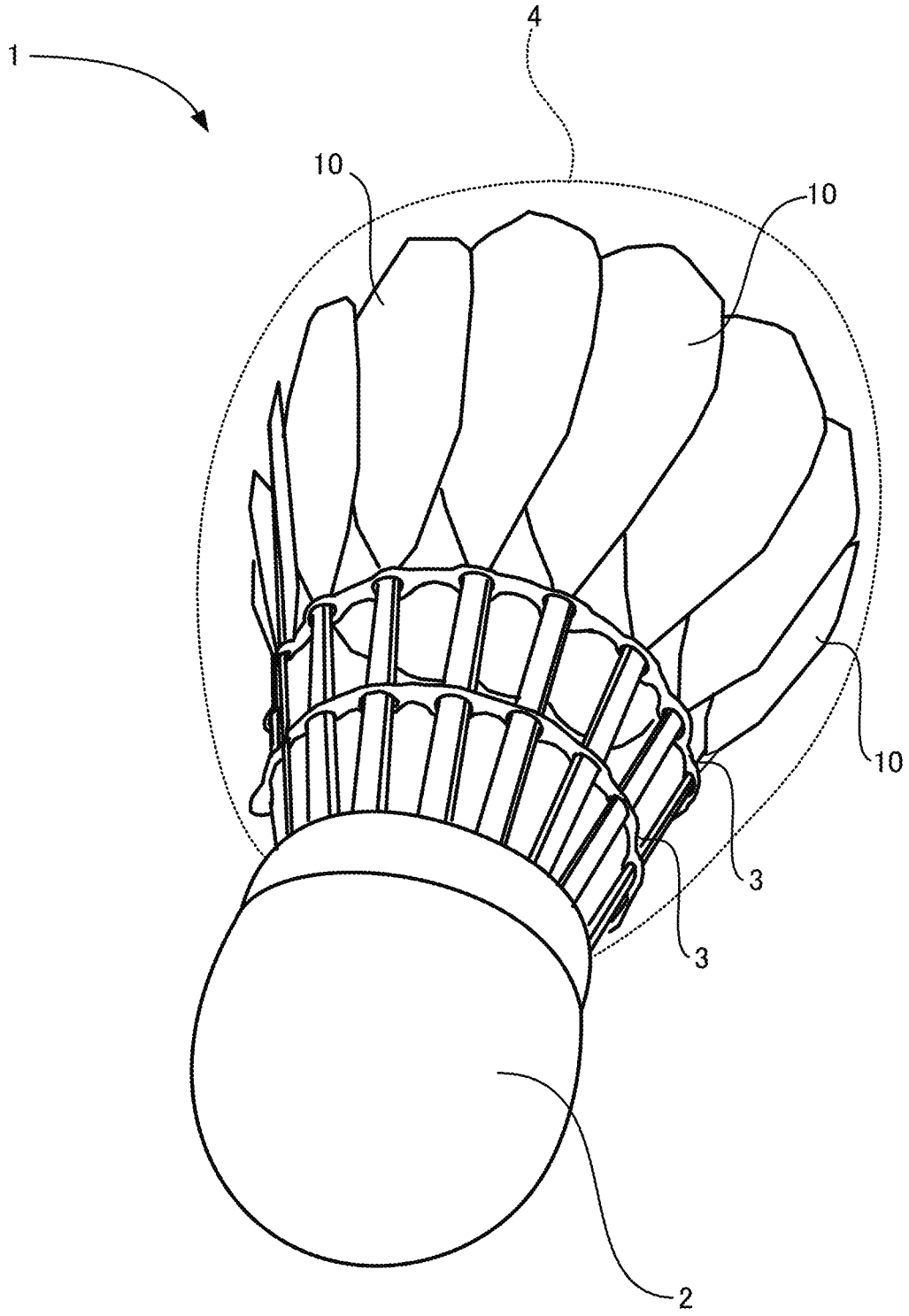
FIG. 1 is a perspective view illustrating an artificial feather shuttlecock, as viewed from a base side.
Figure 2:
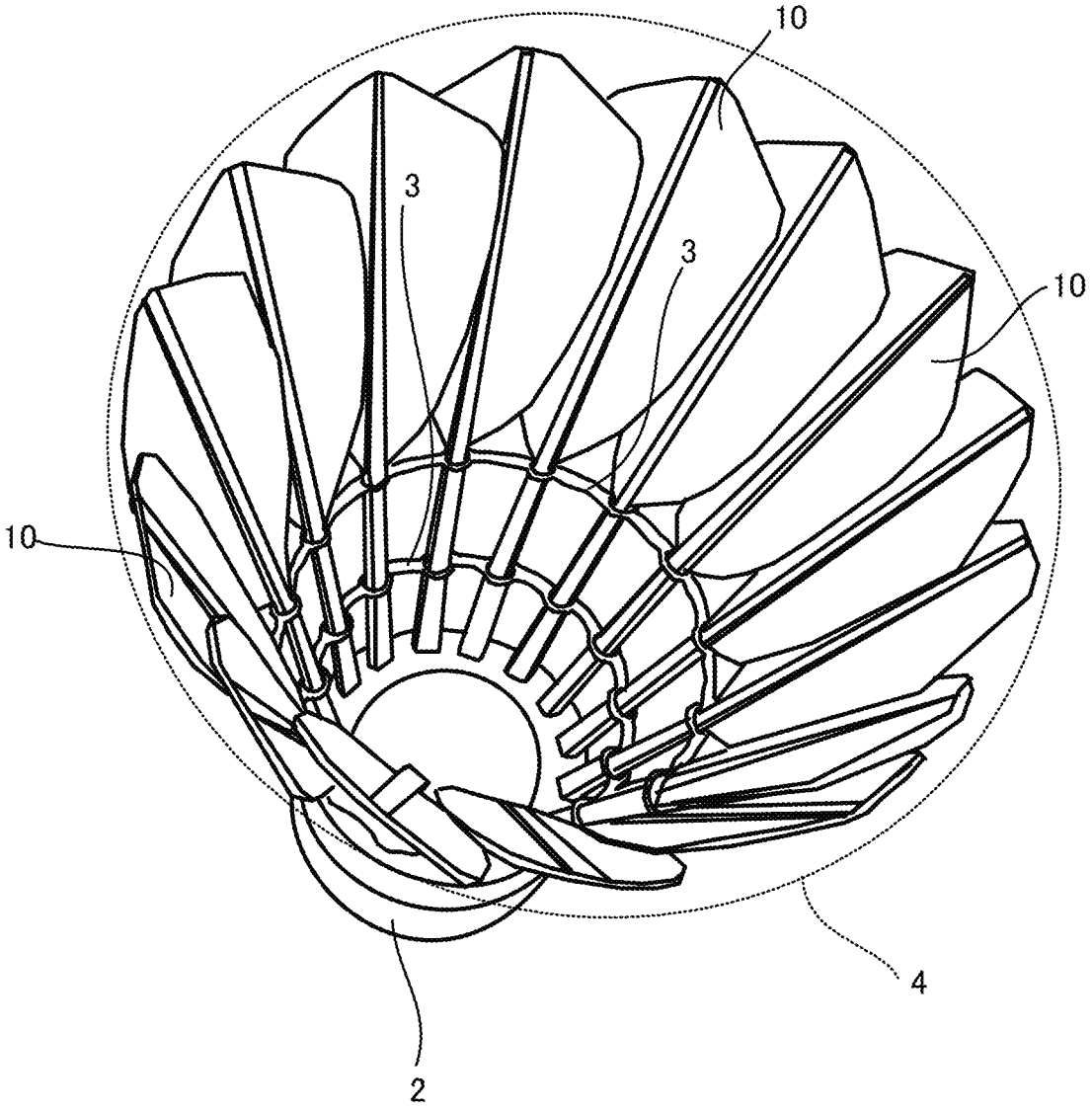
FIG. 2 is a perspective view illustrating an artificial feather shuttlecock, as viewed from an artificial feather side.

FIG. 1 and FIG. 2 are external views to explain the basic structure of an artificial feather shuttlecock 1 provided with artificial feathers 10. FIG. 1 is a perspective view illustrating the artificial feather shuttlecock 1, as viewed from a base 2 side. FIG. 2 is a perspective view illustrating the artificial feather shuttlecock 1, as viewed from the artificial feather 10 side.

The artificial feather shuttlecock 1 includes a base 2, plural of the artificial feathers 10 modelled on natural feathers, and cord shaped members 3 for fixing the artificial feathers 10 together. The base 2 is configured by, for example, covering a cork mounting block with thin leather. The shape of the base 2 is a hemispherical shape having a diameter of from 25 mm to 28 mm and including a flat face. Basal portions (base ends: corresponds to one end) of the plural artificial feathers 10 are embedded in a circular ring shape around the circumference of the flat face. The plural artificial feathers 10 are arranged such that separations therebetween widen on progression away from the base 2. As illustrated in the drawings, each of the artificial feathers 10 is arranged so as to overlap with the respective adjacent artificial feathers 10. A skirt section 4 is thereby formed with the plural artificial feathers 10. The plural artificial feathers 10 are fixed together with the cord shaped members 3 (for example cotton threads).

<Artificial Feather Structure>

Figure 3:
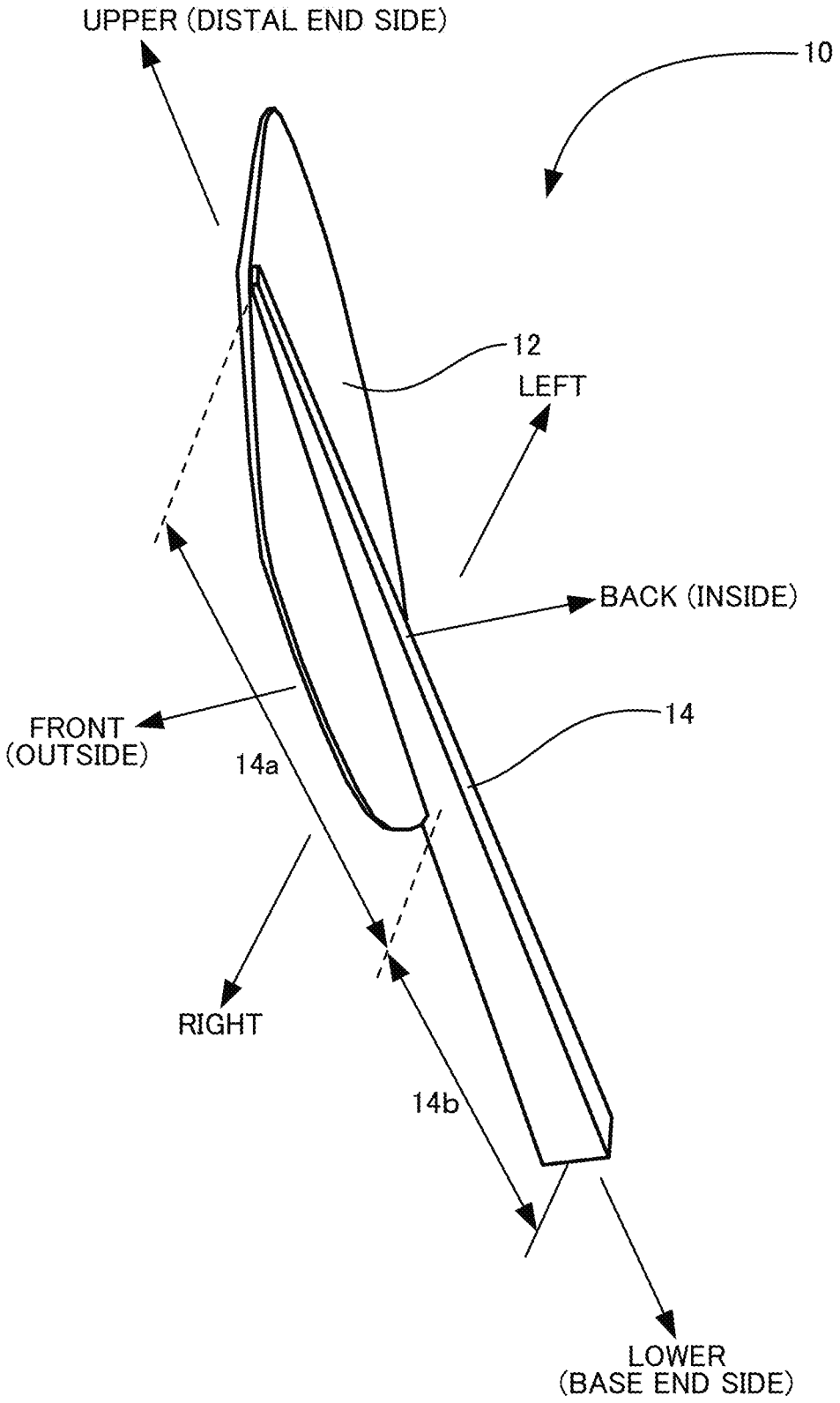
FIG. 3 is an external view of an artificial feather.
Figure 4:
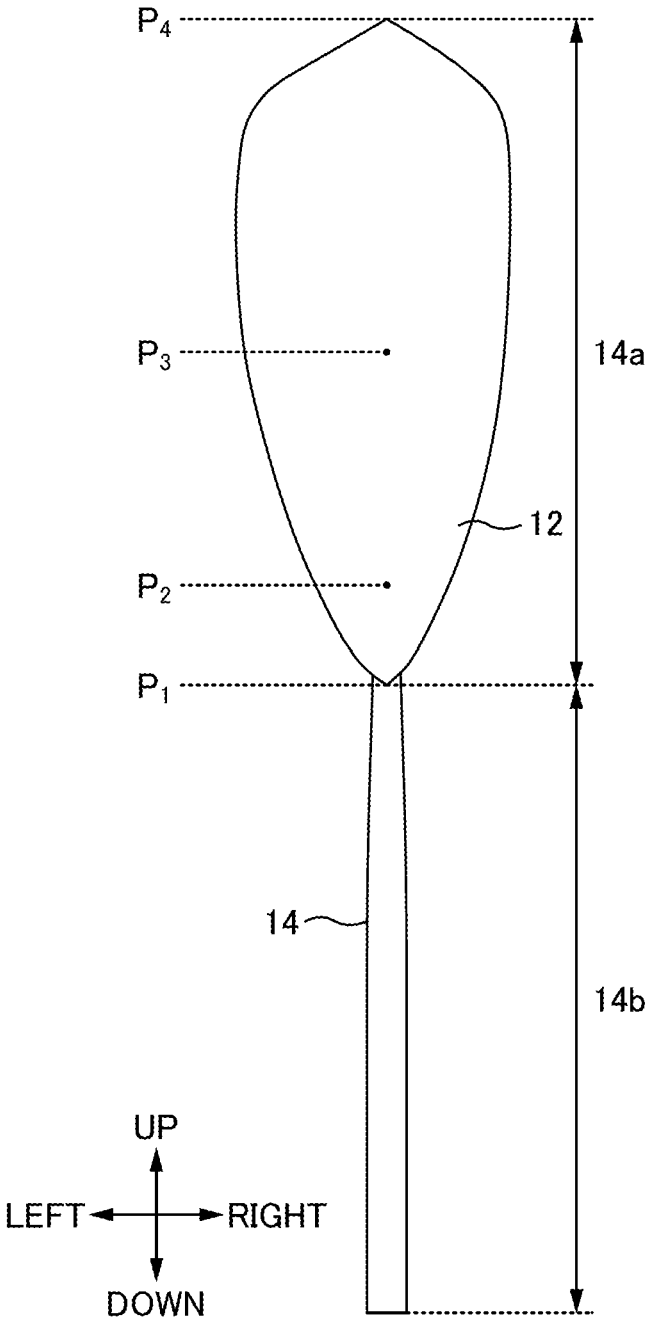
FIG. 4 is a diagram illustrating an artificial feather, as viewed from a back side.

FIG. 3 is an perspective view of an artificial feather 10. FIG. 4 is a diagram illustrating an artificial feather, as viewed from a back side. The same reference signs are appended in the drawings to members that have already been described.

Each of the artificial feathers 10 includes a vane section 12 and a rachis section 14. The vane section 12 is a portion corresponding to vanes of a natural feather, and the rachis section 14 is a portion corresponding to the rachis of a natural feather. In the drawings there is a defined top-to-bottom direction (corresponding to an axial direction) running along the length of the rachis section 14, with the side of the vane section 12 being an upper (distal end side), and the opposite side thereto being a lower (base end side). In the drawings there is also a defined left-to-right direction (corresponding to a width direction) which runs along the direction of extension of the vane section 12 from the rachis section 14. Front and back in the drawings are defined according to the attached state of the artificial feathers 10 to the base 2. Note that a front-to-back direction corresponds to a direction normal to the vane section 12. In a state in which the artificial feathers 10 are arranged in a circular ring shape on the base 2, the front corresponds to the outside and the back corresponds to the inside. Each of the respective configuration elements will now be described using upper/lower, left/right, and front/back as defined in the drawings.

The vane section 12 is a member modelled on the shape of vanes of a natural feather. The vane section 12 may, for example, be configured by a nonwoven cloth, a resin, or the like. In cases in which a nonwoven cloth is employed, a reinforcement covering layer is formed on a front face thereof in order to prevent fibers of the nonwoven cloth from fraying when hit. The reinforcement covering layer may be formed by applying a resin coating. Various coating methods may be employed therefor, such as a dipping method, a spraying method, or a roll-coating method, for example. The reinforcement covering layer may be formed to a single face of the vane section 12, or may be formed to both faces thereof. The reinforcement covering layer may be formed over the entire surface of the vane section 12, or may be formed to part of the vane section 12. The shape of the vane section 12 is not limited to the shape illustrated in the drawings. An elliptical shape may, for example, be adopted therefor.

The rachis section 14 is a long and thin member modelled on the shape of the rachis of a natural feather, and is a member supporting the vane section 12. The rachis section 14 includes a vane support portion 14*a* supporting the vane section 12 over a region from an upper side edge (the position P4 in FIG. 4) to a lower side edge (the position P1 in FIG. 4), and a calamus portion 14*b* projecting beyond the vane section 12. The calamus portion 14*b* is a portion corresponding to the calamus (this location is also referred to as the quill) of a natural feather. A base end of the rachis section 14 (lower end of the calamus portion 14*b*) is embedded in the base 2 so as to be fixed to the base 2. The distal end of the rachis section 14 (corresponds to other end) is aligned with an upper end of the vane section 12. Although cross-section profiles of the rachis section 14 are illustrated as being quadrangle in the drawings, there is no limitation thereto, and other cross-section profiles may be employed.

The rachis section 14 and the vane section 12 may be configured by separate bodies, or may be configured by a single body. For example, when a resin is employed as the material for the rachis section 14 and the vane section 12, the rachis section 14 and the vane section 12 may be molded as a single body by injection molding using a mold. The rachis section 14 and the vane section 12 may also be formed as a single body with different materials for each by injection molding (two-color molding) employing two types of material (resin).

The vane section 12 may be supported in the front side of the vane support portion 14*a*, and the vane section 12 may be supported on the back side of the vane support portion 14*a*. The vane section 12 may also be configured by two sheets, configured such that the vane support portion 14*a* is sandwiched between the two sheet vane section 12. The vane section 12 may also be embedded within the vane support portion 14*a*.

<Flight Performance>

The feathers employed in natural feather shuttlecocks have a low relative density and are extremely light in weight. The rachises of these feathers also have high rigidity, and return to their original shape irrespective of the cumulative number of times they have been hit. Natural feather shuttlecocks therefore obtain a distinctive flight.

If the rigidity of the rachis section 14 were to be raised in the artificial feather shuttlecock 1 employing the artificial feathers 10 then this would lead to an increase in weight of the rachis section 14 and a worse weight balance. This would make the flight performance such as that of a natural feather shuttlecock unobtainable. If, however, the weight of the rachis section 14 were to be reduced and the rigidity lowered, then this would result in slower recovery when hit. The flight performance would accordingly deteriorate. The reason flight performance deteriorates as the weight of the rachis section 14 increases is thought to be as follows.

After being hit, the artificial feather shuttlecock 1 gradually stabilizes while the skirt section 4 repeatedly performs a pendulum motion, with the base 2 acting as the pivot point. When the weight is heavier, the position of the center of gravity shifts toward the skirt section 4 side, and the moment of inertia about the pivot point of the base 2 increases. This acts against attenuation of the pendulum motion, leading to weaving in flight and a loss of directionality (namely, a deterioration in flight performance).

Figure 5:
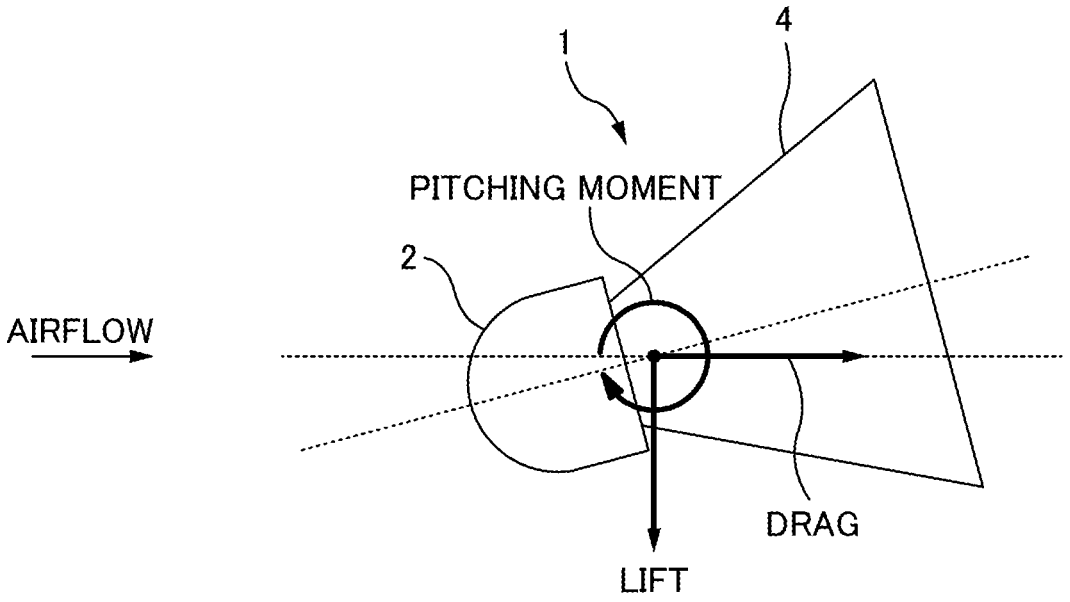
FIG. 5 is a schematic explanatory diagram relating to aerodynamic characteristics of an artificial feather shuttlecock.

FIG. 5 is a schematic explanatory diagram relating to aerodynamic characteristics of the artificial feather shuttlecock 1. The basic aerodynamic characteristics of the artificial feather shuttlecock 1 can be explained in terms of drag, lift, and pitching moment.

Of forces acting on the artificial feather shuttlecock 1 when placed in an airflow, drag is a component (component force) parallel to the direction of airflow. Lift is a component (component force) perpendicular to the direction of airflow.

Pitching moment is a force attempting to return the orientation of the artificial feather shuttlecock 1 when a difference has arisen between the airflow direction and the direction of the base 2 (namely, when the artificial feather shuttlecock 1 is angled with respect to the airflow). The greater the pitching moment, the faster the motion in a direction to return orientation.

It is desirable to shift the position of the center of gravity of the artificial feather shuttlecock 1 toward the base 2 side in order to stabilize flight performance. However if, hypothetically, a weight were to be placed in the base 2, then the overall weight of the artificial feather shuttlecock 1 would increase, resulting in an inferior hitting sensation and making the correct flight distance no longer achievable.

The present embodiment achieves improved flight performance by enhancing the aerodynamic characteristics (pitching moment), while at the same time suppressing an increase in weight. Specifically, in an artificial feather 10 of the present embodiment, plural holes (holes 122, described later) are provided in the vane section 12, so as to penetrate the vane section 12. An improvement in the pitching moment is thereby achieved. However, providing holes uniformly over the entire surface of the vane section 12 might reduce the lift acting on the artificial feather shuttlecock 1.

Figure 6:
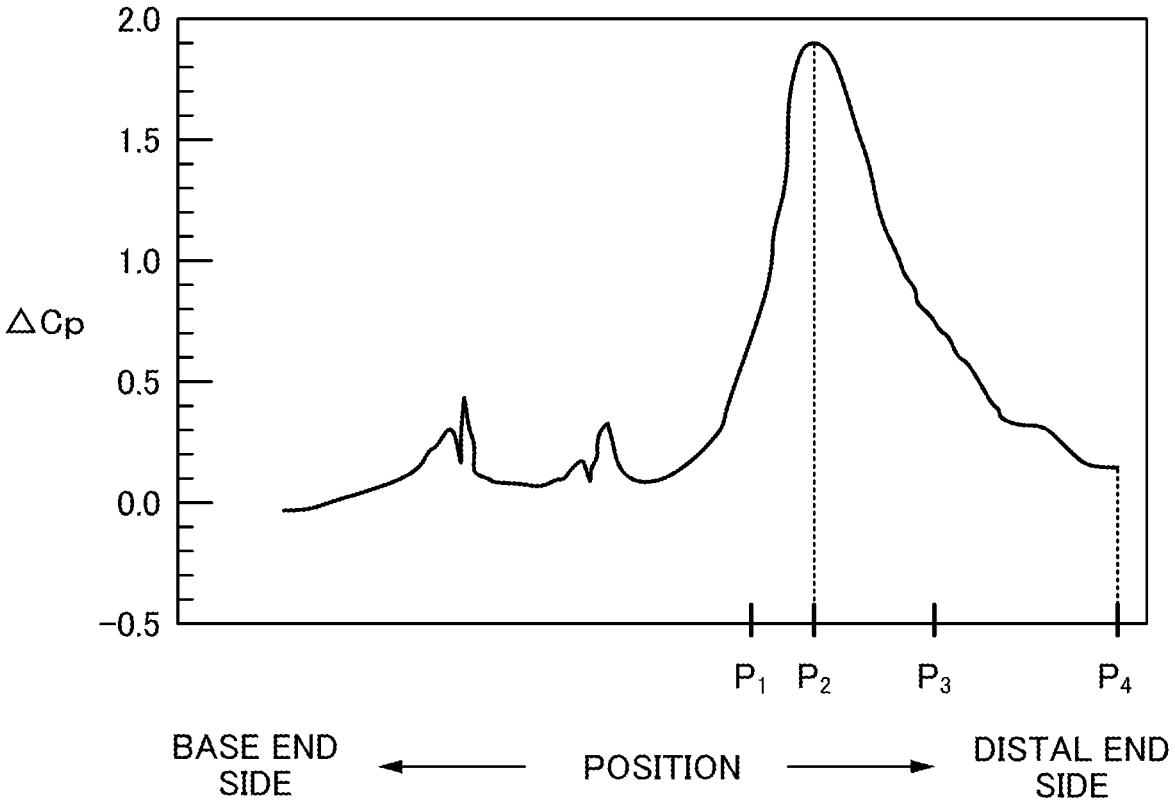
FIG. 6 is an explanatory diagram relating to pressures acting on an artificial feather during flight of an artificial feather shuttlecock.

FIG. 6 is a graph illustrating a difference in pressure that occurs between the two surfaces (front surface and back surface) of the artificial feather 10 during flight of the artificial feather shuttlecock 1 (see Journal of Fluids and Structures 41, 89 to 98).

The position on the artificial feather shuttlecock 1 is shown on the horizontal axis of the graph, and a pressure difference ($\Delta Cp$) between the positive pressure surface (the front surface in this example) and the negative pressure face (the back surface in this example) is shown on the vertical axis. The positions P1 to P4 on the horizontal axis in FIG. 6 correspond to the respective positions on the vane section 12 (on the vane support portion 14*a*) in FIG. 4, with the calamus portion 14*b* lying to the left of the position P1 in FIG. 4. The position P3 is a center of the vane section 12 in the top-to-bottom direction (the center point between the position P1 and the position P4).

As illustrated in the drawings, the pressure difference ($\Delta Cp$) between the positive pressure surface and the negative pressure surface is greatest at the position P2 to the lower side (base end side) of the position P3. The artificial feather shuttlecock 1 generates the greatest lift in the position P2. In this example, the position P2 is positioned from the position P1 of the vane section 12 at a distance of approximately 15% of the total length of the vane section 12 in the top-to-bottom direction (i.e. of the distance between the position P1 and the position P4). The position where the pressure difference is greatest (position P2) varies slightly according to the shape and material of the vane section 12, the rigidity of the rachis section 14 and the like. However, this position is not thought to vary much (is to the lower side of the position P3) in artificial feather shuttlecocks 1 employing the artificial feathers 10 modelled on feathers. In the present embodiment, holes are arranged such that there are no holes provided further toward the lower side than the position P2 (a region from the position P1 to the position P2).

<Improved Example of Artificial Feather (Present Embodiment)>

Figure 7:
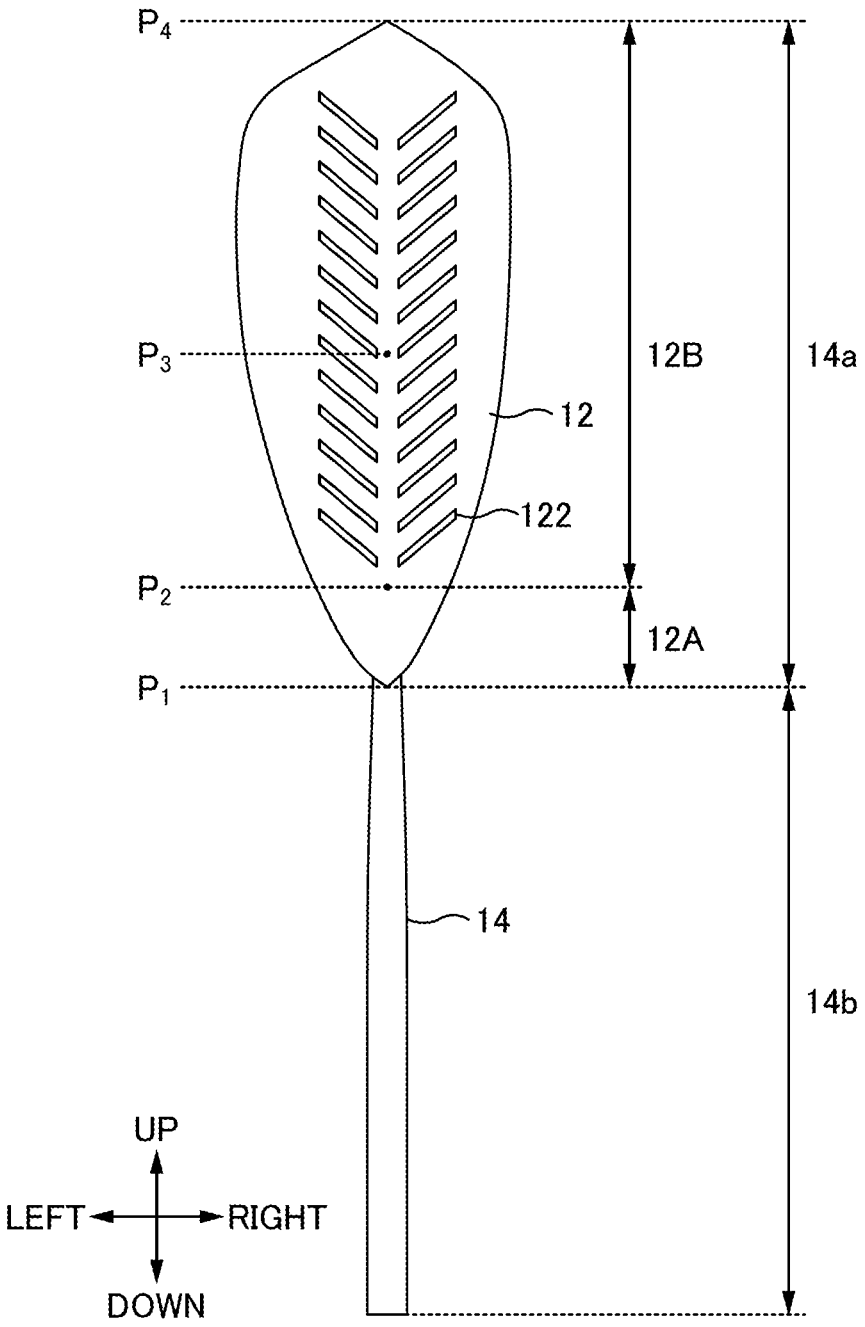
FIG. 7 is a diagram illustrating an artificial feather of a present embodiment, as viewed from the back side.

FIG. 7 is a diagram illustrating an artificial feather 10 of the present embodiment, as viewed from the back side. A rachis section 14 of the artificial feather 10 in the present embodiment is the same as that of the above artificial feather 10 (FIG. 4), and so description thereof is omitted.

Holes 122 are provided in a vane section 12 of the artificial feather 10 in the present embodiment so as to penetrate the vane section 12 in the front-to-back direction. The holes 122 are elongated holes each having a long and thin profile oriented in a direction angled with respect to (intersecting) the left-to-right direction (width direction) and the top-to-bottom direction (axial direction). More specifically, the holes 122 are each formed with a profile slanting upward (away from the base 2) on progression away from the rachis section 14. Plural of the holes 122 are arranged in rows along the top-to-bottom direction at a prescribed separation from each other. The plural holes 122 are arranged with left-right symmetry about the rachis section 14. This thereby enables good balance to be achieved in the left-to-right direction.

<Positions for Forming Holes 122>

In the present embodiment, there are no holes 122 provided in a region spanning a range from the position P1, i.e. from a lower side (base end side) edge of the vane section 12, to the position P2 (hereafter this region is also referred to as the first region 12A). The holes 122 are provided in a region spanning from the position P2 to the position P4, i.e. to an upper side (distal end side) edge of the vane section 12 (hereafter this region is also referred to as the second region 12B). The reason for forming the holes 122 in this manner is described below.

As described earlier with reference the FIG. 6, when the artificial feather shuttlecock 1 is in flight, the pressure difference between the positive pressure surface (the front surface in this example) and the negative pressure surface (the back surface in this example) of the vane section 12 is greatest in the position P2 of the vane section 12, and the greatest lift is generated in the position P2.

The pressure at the negative pressure surface rises toward the distal end side (i.e. the downstream side in relation to the direction of airflow) of the position P2, resulting in a countervailing pressure gradient. The airflow therefore separates at the distal end side (downstream side) of the position P2. There is, however, no separation of airflow over the region (first region 12A) at the base end side (upstream side) of the position P2, and lift is generated therein.

Supposing the holes 122 were to be formed in the first region 12A where lift is being generated, then there would be a reduction in lift, which might result in a worsening of flight performance.

By contrast, in the present embodiment, the holes 122 are not provided in the first region 12A, and the holes 122 are provided in the second region 12B. This enables a flow to be induced to flow efficiently from the front surface (positive pressure surface) side to the back surface (negative pressure surface) side. This enables separation of airflow to be suppressed and enables lift to be increased. This thereby enables an increase in the pitching moment about the vane section 12, and an increase in the pitching moment of the artificial feather shuttlecock 1 taken as a whole. An improvement is accordingly able to be achieved in the flight performance of the artificial feather shuttlecock 1.

The holes 122 of the present embodiment are elongated holes, and setting (optimizing) the length and angle of the holes 122 enables the airflow to pass from the front surface side to the back surface side with good efficiency. This thereby enables separation of the airflow to be further suppressed, and enables lift to be increased further.

Accordingly, the porosity of the first region 12A is 0% due to there being no holes 122 provided in the first region 12A of the vane section 12, and is thus smaller than the porosity of the second region 12B. Reference here to porosity means the proportion of surface area (openings) of the holes 122 with respect to the surface area of the front surface of the vane section 12 for each of the respective regions, and is expressed as a percentage.

Although in the present embodiment the holes 122 are formed regularly (at a prescribed separation) in the vane section 12, the holes 122 are not necessarily formed regularly (namely, they may be formed irregularly). For example, in the present embodiment, a length of the first region 12A in the top-to-bottom direction (the distance between the position P1 and the position P2) is greater than separations between the adjacent holes 122, and greater than the length in the top-to-bottom direction of opening portions of the holes 122. There may, however, be a location where the separation between adjacent holes 122 is greater than the length of the first region 12A in top-to-bottom direction.

<Quantity of Holes 122 Formed>

Figure 8:
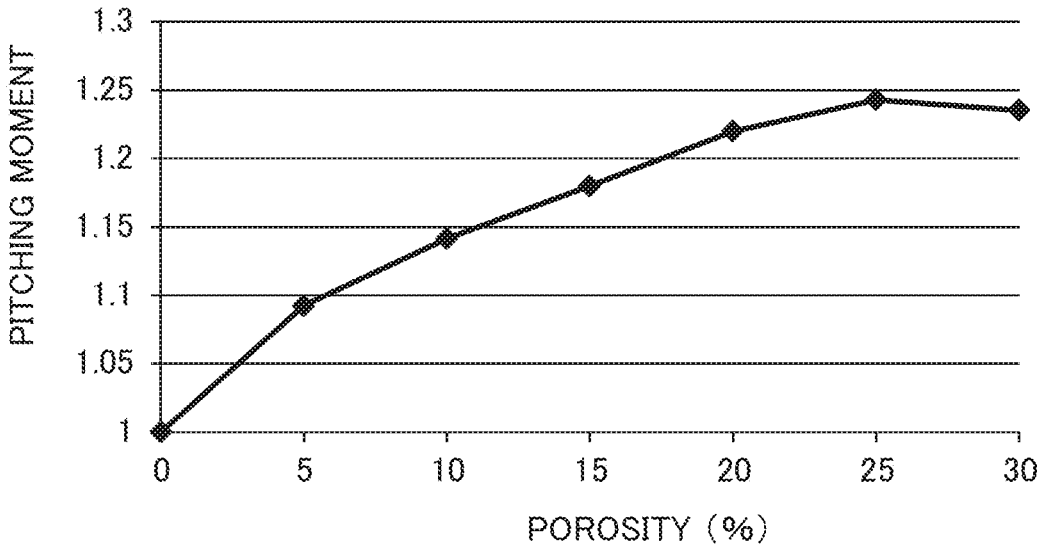
FIG. 8 is a graph illustrating a relationship between a porosity of a vane section and pitching moment.

FIG. 8 is a graph illustrating a relationship between porosity of the vane section 12 and pitching moment. The porosity of the vane section 12 taken as a whole is shown on the horizontal axis in FIG. 8. For example, the porosity is 0% for the vane section 12 of FIG. 4 (a case in which no holes 122 are provided). The pitching moment is shown on the vertical axis in FIG. 8. The pitching moment is measured under the following conditions: wind speed 10 m/s; angle of attack ±24° (at intervals of 3°); no shuttlecock spin.

As illustrated in the graph, the pitching moment increases as the porosity increases over a range of from 0% to 25%. For example, when the porosity is 5%, the pitching moment is approximately 9% greater than that at a porosity of 0% (FIG. 4).

The pitching moment of a natural feather shuttlecock is approximately 1.1, and a porosity of 5% is substantially equivalent to that of a natural feather shuttlecock. In order to obtain aerodynamic characteristics close to those of a natural feather shuttlecock it is accordingly preferable to have a porosity of 5% or greater for the vane section 12 as a whole.

However, when the porosity is 30% or greater, this might lead to too large gaps and not being able to secure durability. The porosity is accordingly preferably in a range of 5% up to, but not including, 30% (and more preferably up to, but not including, 20%).

As described above, plural of the holes 122 are provided in the second region 12B on the upper side (distal end side) of the position P2 of the vane section 12 in the artificial feather 10 of the present embodiment, but there are no holes 122 provided in the first region 12A (i.e. the porosity of the first region 12A is lower than the porosity of the second region 12B). This thereby enables the pitching moment to be raised while suppressing a reduction in lift, thereby enabling an improvement in flight performance to be achieved.

Modified Examples

Figure 9:
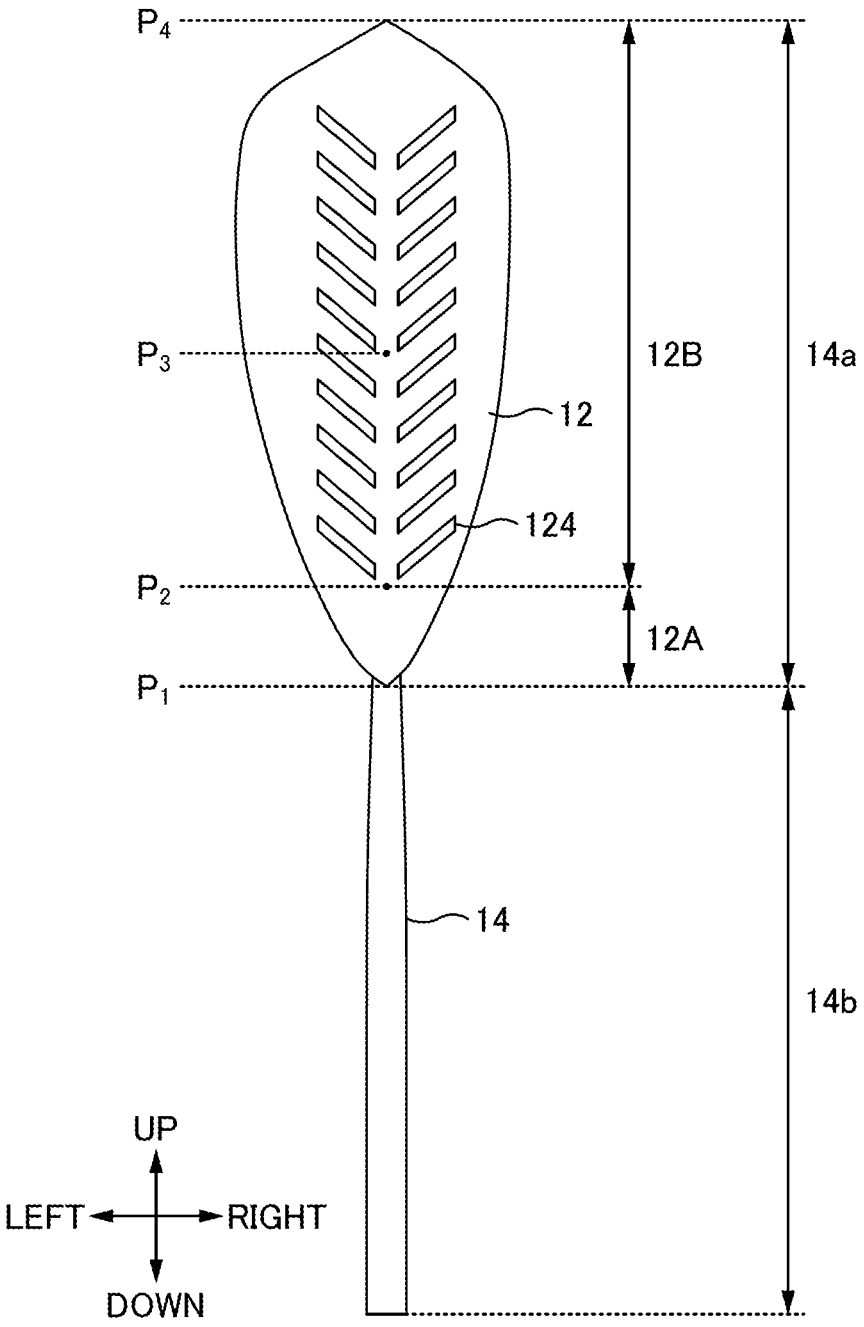
FIG. 9 is a diagram illustrating an artificial feather of a first modified example, as viewed from the back side.

FIG. 9 is a diagram illustrating an artificial feather 10 of a first modified example, as viewed from the back side.

Plural holes 124 are provided in a vane section 12 of the artificial feather 10 of the first modified example. Opening widths (top-to-bottom direction lengths) of the holes 124 are greater than the opening widths of the holes 122 of the above embodiment, and the separation between the adjacent holes 124 is also greater than the separation between the holes 122 in the above embodiment. Namely, the number of the holes 124 in the first modified example is fewer than in the above embodiment. Similarly to in the above embodiment, the holes 124 are provided in a second region 12B to the upper side (distal end side) of the position P2.

Figure 10:
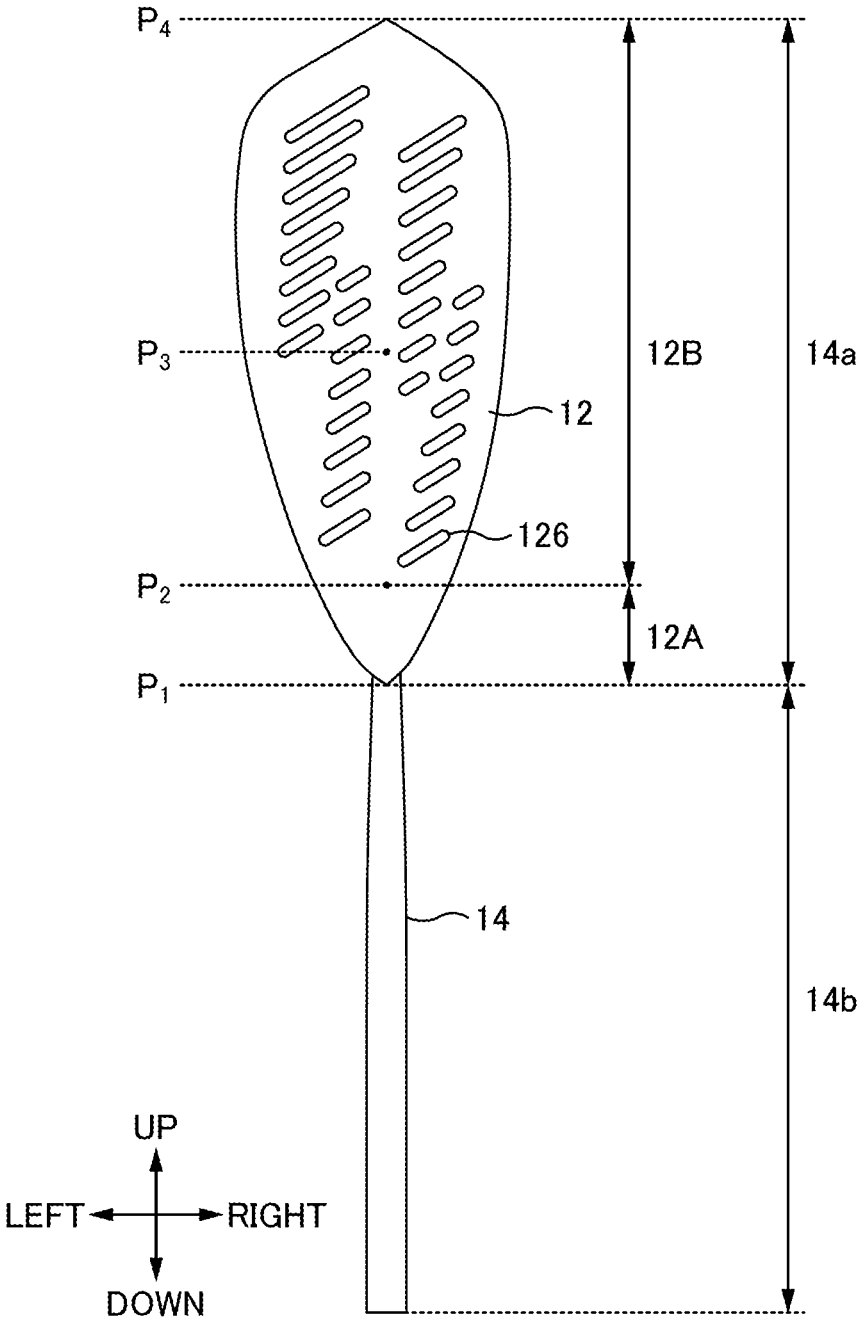
FIG. 10 is a diagram illustrating an artificial feather of a second modified example, as viewed from the back side.

FIG. 10 is a diagram illustrating an artificial feather 10 of a second modified example, as viewed from the back side.

Plural holes 126 are provided in a vane section 12 of the artificial feather 10 of the second modified example. In the second modified example, the forming positions where the holes 126 are formed are not arranged symmetrically with respect to a rachis section 14 (are asymmetrical in the left-to-right direction). Namely, irrespective of the position on the vane section 12, the holes 126 are still provided so as to slant upward (away from the base 2) on progression toward the left, with the right end of each of the holes 126 being the lowermost position thereof (closest to the base 2). There is, however, no limitation thereto, and, for example, the direction of slanting may be left-right reversed. There are no holes (holes 122, holes 124) formed in width direction end portions (left-to-right direction end portions) of the vane section 12 in the above embodiment. However, the holes 126 in the second modified example are also formed at positions closer to the end (specifically, at locations overlapping with the adjacent vane section 12). Similarly to in the above embodiment, the holes 126 are provided in the second region 12B to the upper side (distal end side) of the position P2.

Figure 11:
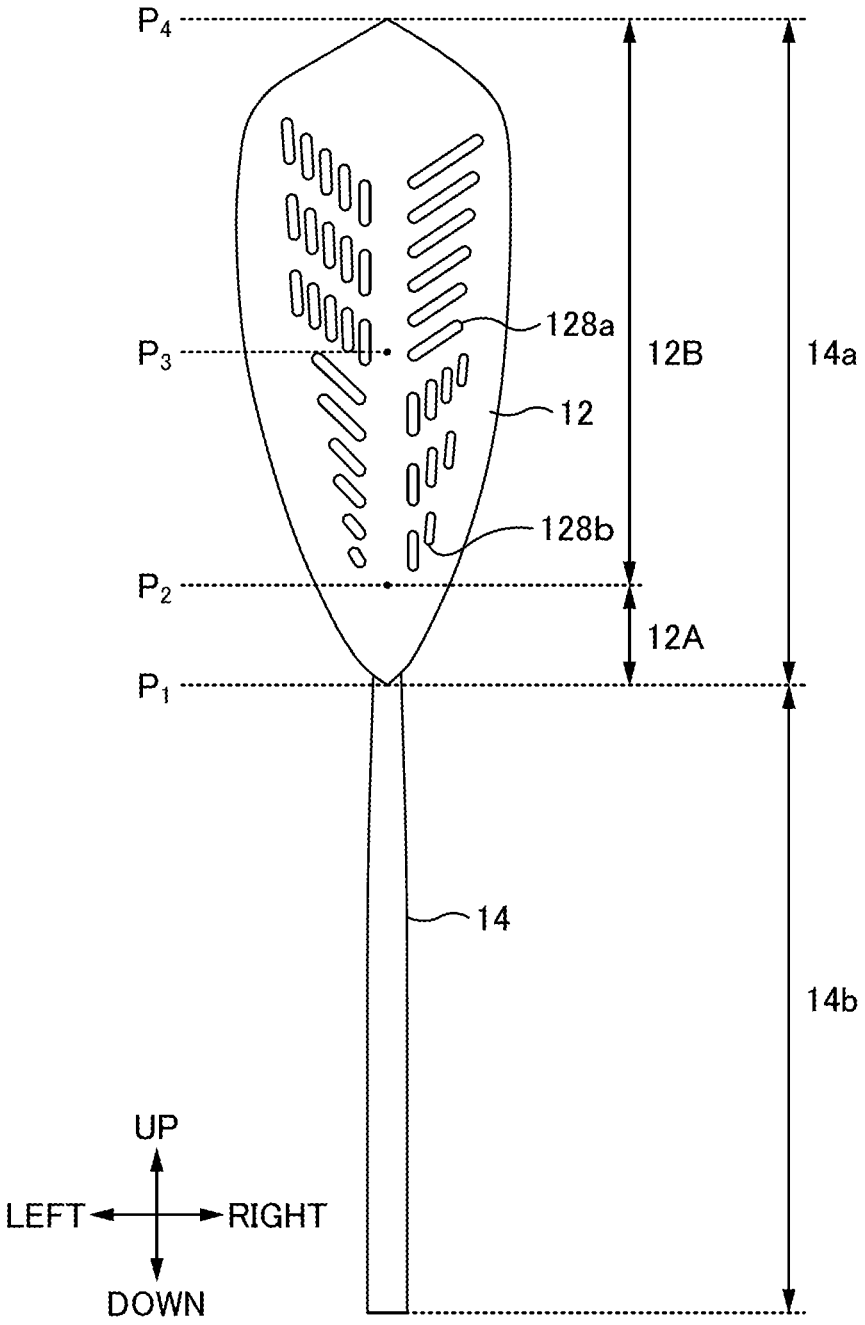
FIG. 11 is a diagram illustrating an artificial feather of a third modified example, as viewed from the back side.

FIG. 11 is a diagram illustrating an artificial feather 10 of a third modified example, as viewed from the back side.

Plural holes 128*a* and 128*b* are each provided in a vane section 12 of the artificial feather 10 of the third modified example. The forming positions where the holes 128*a*, 128*b* are formed are also arranged asymmetrically with respect to the rachis section 14 in this example too.

The holes 128*a* are elongated holes each having a long and thin profile oriented in a direction angled with respect to (intersecting) the left-to-right direction (width direction) and the top-to-bottom direction (axial direction).

The holes 128*b* are formed parallel to the axis of the rachis section 14 (along the top-to-bottom direction). Namely, the holes 128*b* are elongated holes each having a long and thin profile oriented so as not to intersect with the top-to-bottom direction, but to intersect (orthogonally) with the left-to-right direction.

The vane section 12 of the third modified example includes a mix of both regions in which plural of the holes 128*a* are arrayed in rows along the top-to-bottom direction at a prescribed separation from each other, and regions in which plural of the holes 128*b* are arrayed in rows along the left-to-right direction at a prescribed separation from each other. The holes 128 (the holes 128*a* and the holes 128*b*) are also provided in the second region 12B to the upper side (distal end side) of the position P2 in this example too.

In each of the modified examples described above, the porosity of the first region 12A is 0%, i.e. a lower porosity than that of the second region 12B. This thereby enables an improvement in flight performance to be achieved, similarly to in the above embodiment (FIG. 7).

Other Points

The above embodiment modes are to facilitate understanding of this invention, and are not for limiting this invention in any way. It is needless to say that this invention can be changed or modified without deviating from the scope, and this invention includes its equivalents.

Although the holes (the holes 122, 124, 126, 128*a*, 128*b*) that are provided to the vane section 12 in the above embodiments are each elongated holes that are long and thin, there is no limitation thereto. For example, holes with a circular profile (round holes) or holes with a polygonal profile may be provided. However, as described above, with elongated holes the airflow is able to pass efficiently from the front surface side to the back surface side, enabling separation of the airflow to be suppressed and also enabling lift to be increased. Elongated holes are therefore preferably employed.

Moreover, although plural holes are provided in the vane section 12 in the above embodiments, a configuration may be adopted in which at least one (a single) hole is provided.

Although the vane section 12 is sheet shaped in the above embodiment, there is no limitation thereto. For example, a three dimensional (3D) shape may be adopted therefor.

Although there are no holes provided in the first region 12A in the above embodiments (i.e. the porosity is 0%), holes may be provided therein. In such cases, setting the porosity of the first region 12A lower than the porosity of the second region 12B enables better flight performance to be achieved than when holes are provided uniformly over the entire vane section 12. However, setting porosity to 0% (providing no holes) in the first region 12A, as in the present embodiment, enables a greater improvement to be achieved in flight performance.

REFERENCE SIGNS LIST

1 artificial feather shuttlecock,
2 base,
3 cord shaped member,
4 skirt section,
10 artificial feather,
12 vane section,
12A first region,
12B second region,
14 rachis section,
14*a* vane support portion,
14*b* calamus portion,
122, 124, 126, 128*a*, 128*b* hole

The invention claimed is:

1. An artificial shuttlecock feather that is to be implanted in a circular ring shape into a base of a shuttlecock, the artificial shuttlecock feather comprising:

a vane section; and a rachis section having one end in an axial direction of the rachis section fixed to the base and supporting the vane section provided to another end side of the rachis section, a hole being formed in the vane section so as to penetrate the vane section, and a porosity of a first region of the vane section being lower than a porosity of a second region of the vane section, the first region spanning from an edge on the one end side in the axial direction to a predetermined position further toward the one end side than a center of the vane section in the axial direction, the second region spanning from the predetermined position to an edge on the other end side in the axial direction, the hole being an elongated hole formed oriented in a direction angled with respect to a width direction and the axial direction wherein the predetermined position is a position of greatest pressure difference between one surface of the vane section and another surface of the vane section during flight of the shuttlecock.

2. The artificial shuttlecock feather according to claim 1, wherein the porosity of the first region is 0%.

3. The artificial shuttlecock feather according to claim 1, wherein a plurality of the holes are formed, and a length from the edge on the one end side of the vane section to the predetermined position is greater than a separation between adjacent holes out of the holes.

4. The artificial shuttlecock feather according to claim 1, wherein the hole is an elongated hole formed oriented in a direction angled with respect to a width direction and the axial direction.

5. The artificial shuttlecock feather according to claim 1, wherein the porosity of the feather section taken as a whole is from 5% up to, but not including, 30%.

6. A shuttlecock employing the artificial shuttlecock feather according to claim 1.

7. The artificial shuttlecock feather according to claim 1, wherein the predetermined position is approximately 15% of a total length of the vane section in the axial direction.

8. The artificial shuttlecock feather according to claim 1, wherein the hole is one of a plurality of holes, each hole being elongated, and wherein the plurality of holes are arranged asymmetrically with respect to the rachis section.

* * * * *